US012029954B2

(12) United States Patent
Trevino

(10) Patent No.: US 12,029,954 B2
(45) Date of Patent: Jul. 9, 2024

(54) BASEBALL TRAINING APPARATUS

(71) Applicant: Christopher Michael Trevino, Bedford, TX (US)

(72) Inventor: Christopher Michael Trevino, Bedford, TX (US)

( * ) Notice: Subject to any disclaimer, the term of this patent is extended or adjusted under 35 U.S.C. 154(b) by 0 days.

(21) Appl. No.: 17/387,706

(22) Filed: Jul. 28, 2021

(65) Prior Publication Data

US 2023/0035887 A1 Feb. 2, 2023

(51) Int. Cl.
*A63B 69/00* (2006.01)
*A63B 71/00* (2006.01)

(52) U.S. Cl.
CPC ..... *A63B 69/0075* (2013.01); *A63B 69/0002* (2013.01); *A63B 2069/0008* (2013.01); *A63B 2225/093* (2013.01)

(58) Field of Classification Search
CPC ..... A63B 69/0075; A63B 69/0002
USPC ..... 473/451
See application file for complete search history.

(56) References Cited

U.S. PATENT DOCUMENTS 3,550,938 A * 12/1970 Cunningham, Jr. ... A63B 69/40 473/429
4,664,374 A * 5/1987 Groves ..... A63B 69/0075 473/417
4,989,866 A * 2/1991 Dill ..... A63B 69/0075 473/417
5,662,536 A * 9/1997 Martinez ..... A63B 69/0075 473/417
5,893,806 A * 4/1999 Martinez ..... A63B 69/0075 473/447
5,928,092 A * 7/1999 Keeter ..... A63B 69/0075 473/417
6,413,175 B1 * 7/2002 Mooney, Jr. ..... A63B 69/0075 473/422
6,475,108 B1 * 11/2002 Sarenana, Sr. ..... A63B 69/0075 473/417
6,666,781 B1 * 12/2003 Illis ..... A63B 69/0084 473/417
8,033,934 B1 * 10/2011 Clancy ..... A63B 43/007 473/422
8,414,429 B2 * 4/2013 Belt ..... A63B 69/0075 473/417
8,597,143 B2 * 12/2013 Newman ..... A63B 69/0075 473/417
8,992,348 B2 * 3/2015 Meier ..... A63B 69/0057 473/417

(Continued)

*Primary Examiner* — Mitra Aryanpour
(74) *Attorney, Agent, or Firm* — Law Office of Jeff Williams PLLC; J. Oliver Williams

(57) ABSTRACT

A training apparatus includes a base, a main stem, and an auxiliary arm. The main stem and detachable auxiliary arm create a double batting tee within a single unit. The height of the auxiliary arm is adjustable independent of the main stem and has the ability to swivel around the main stem. The auxiliary arm is curved and situated at a fixed horizontal position from the main stem. The weighted base includes a handle and detachable tee for ease of transport. The base was designed to be able to secure the weight of both tee stems without toppling over. A specially designed clamp was designed to secure and detach the auxiliary arm to the main stem. The clamp can be loosened to adjust the height of the auxiliary arm in relation to the main stem.

14 Claims, 4 Drawing Sheets

(56) References Cited

U.S. PATENT DOCUMENTS

| | | | | |
|---|---|---|---|---|
| 9,457,252 | B2 * | 10/2016 | Schwarz | A63B 69/0075<br>473/417 |
| 2004/0077436 | A1 * | 4/2004 | Goucher | A63B 71/023<br>473/451 |
| 2008/0085787 | A1 * | 4/2008 | Molloy | A63B 69/0075<br>473/417 |
| 2011/0244992 | A1 * | 10/2011 | Clancy | A63B 69/0002<br>473/430 |
| 2012/0202621 | A1 * | 8/2012 | Belt | A63B 69/0075<br>473/417 |
| 2016/0114237 | A1 * | 4/2016 | Garcia, Jr. | B65D 25/10<br>206/315.1 |
| 2016/0129329 | A1 * | 5/2016 | Fadde | A63B 69/0002<br>473/417 |
| 2016/0287962 | A1 * | 10/2016 | Lee | A63B 69/0002<br>473/417 |
| 2020/0238146 | A1 * | 7/2020 | Taulelle | A63B 69/0002<br>473/417 |

* cited by examiner

BASEBALL TRAINING APPARATUS

BACKGROUND OF THE INVENTION

1. Field of the Invention

The present application relates to a sport training device, and more particularly to a baseball training apparatus to help improve a player's swing.

2. Description of Related Art

There are a variety of baseball tees on the market that utilize a prefabricated base with multiple positions. These devices are used to support a baseball at a selected height and are used to assist in developing a player's swing motion. The tee stems can be adjustable to accommodate different player sizes. In some situations, an additional tee may be used adjacent to an existing tee, however, it is not all inclusive into a single baseball tee and the location of the additional tees are limited to a number of preset locations. These preset locations hinders the ability of the trainer or coach to adapt the devices for different sized players. A common area of concern is adequate ballast weight distributed properly in existing baseball tees.

Although strides have been made, shortcomings remain. It is desired that an assembly be provided that is customizable for all sized players and incorporates a singular assembly with two distinct tees.

BRIEF SUMMARY OF THE INVENTION

It is an object of the present application to provide a singular tee assembly that incorporates a double tee design as a singular unit. An auxiliary arm may be releasably coupled to a portion of a main tee stem to provide a dual tee configuration. The tee stem and the auxiliary arm are adjustable in height to accommodate different training exercises for different sized players.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
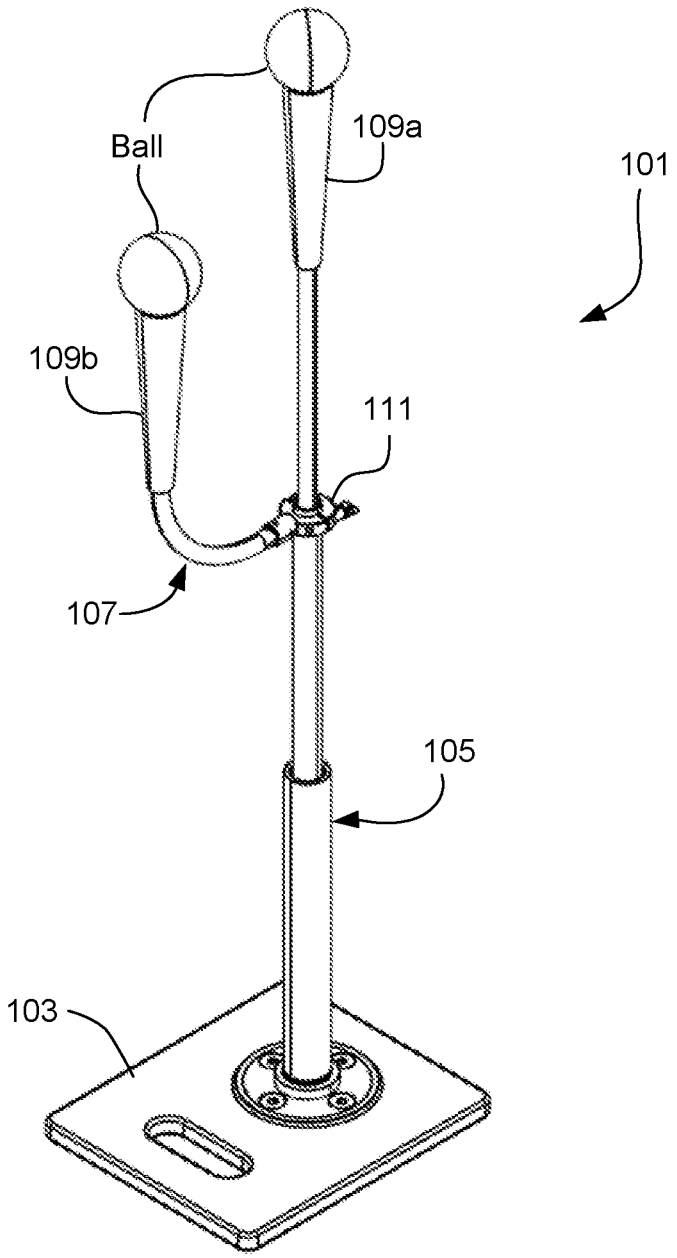
FIG. 1 is a perspective view of a baseball training apparatus according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the baseball training apparatus of the present application provides a dual tee configuration These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments and method of the present application is illustrated in the associated drawings. The batting tee includes a main stem and a detachable auxiliary arm to create a double batting tee within a single unit. The height of the detachable auxiliary arm is adjustable independent of the main stem of the batting tee and has the ability to rotate around the main stem. The auxiliary arm is curved and situated at a fixed horizontal position from the main stem. The weighted base has been designed with a handle and detachable tee for ease of transport. The base was designed to be able to secure the weight of both tee stems without toppling over. A specially designed clamp was designed to secure and detach the auxiliary arm to the stem of the main tee. The clamp can be loosened to adjust the height of the auxiliary arm in relation to the main stem. Additional features and functions are illustrated and discussed below.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Figure 2:
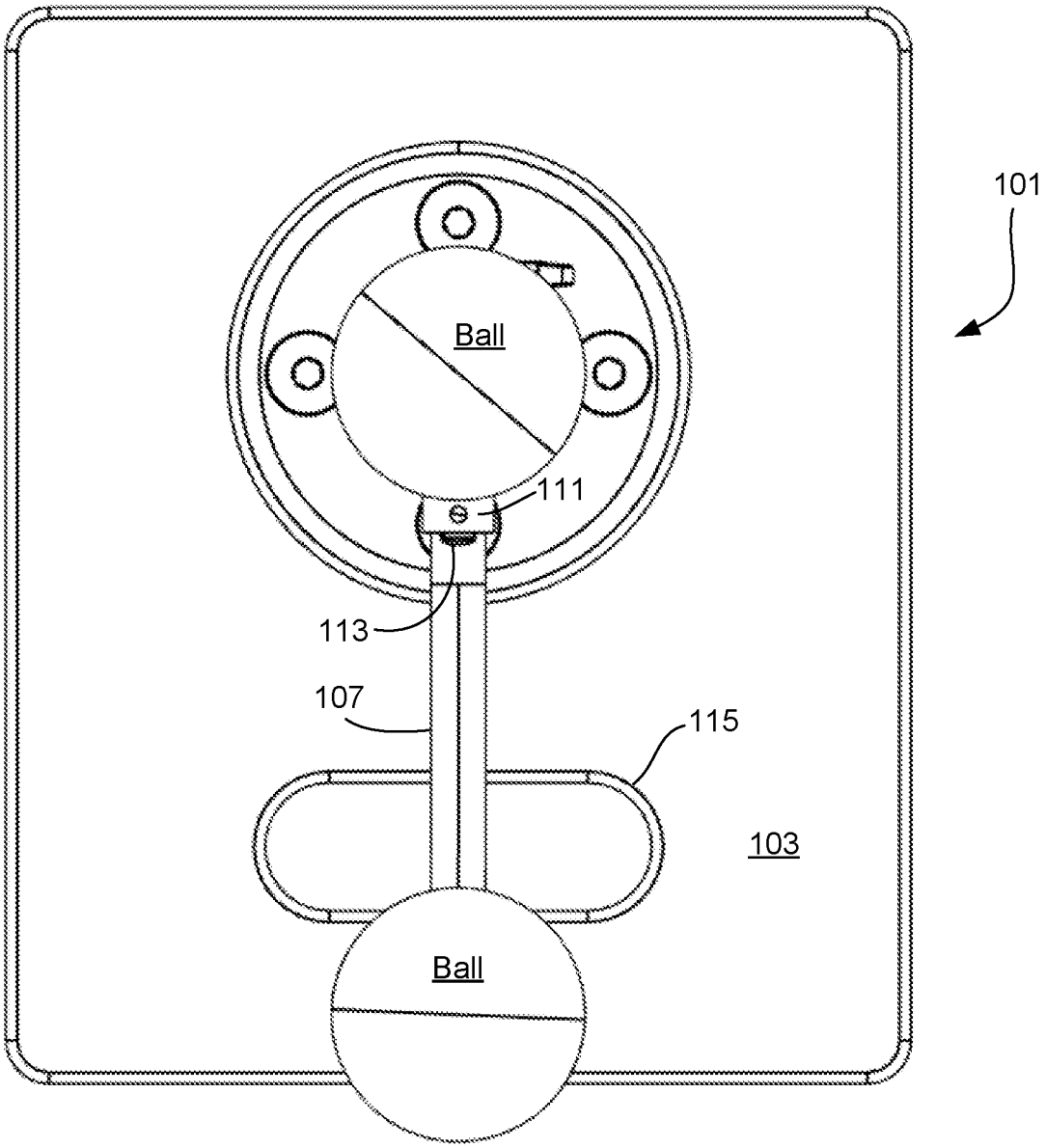
FIG. 2 is a top view of the training apparatus of FIG. 1.
Figure 3:
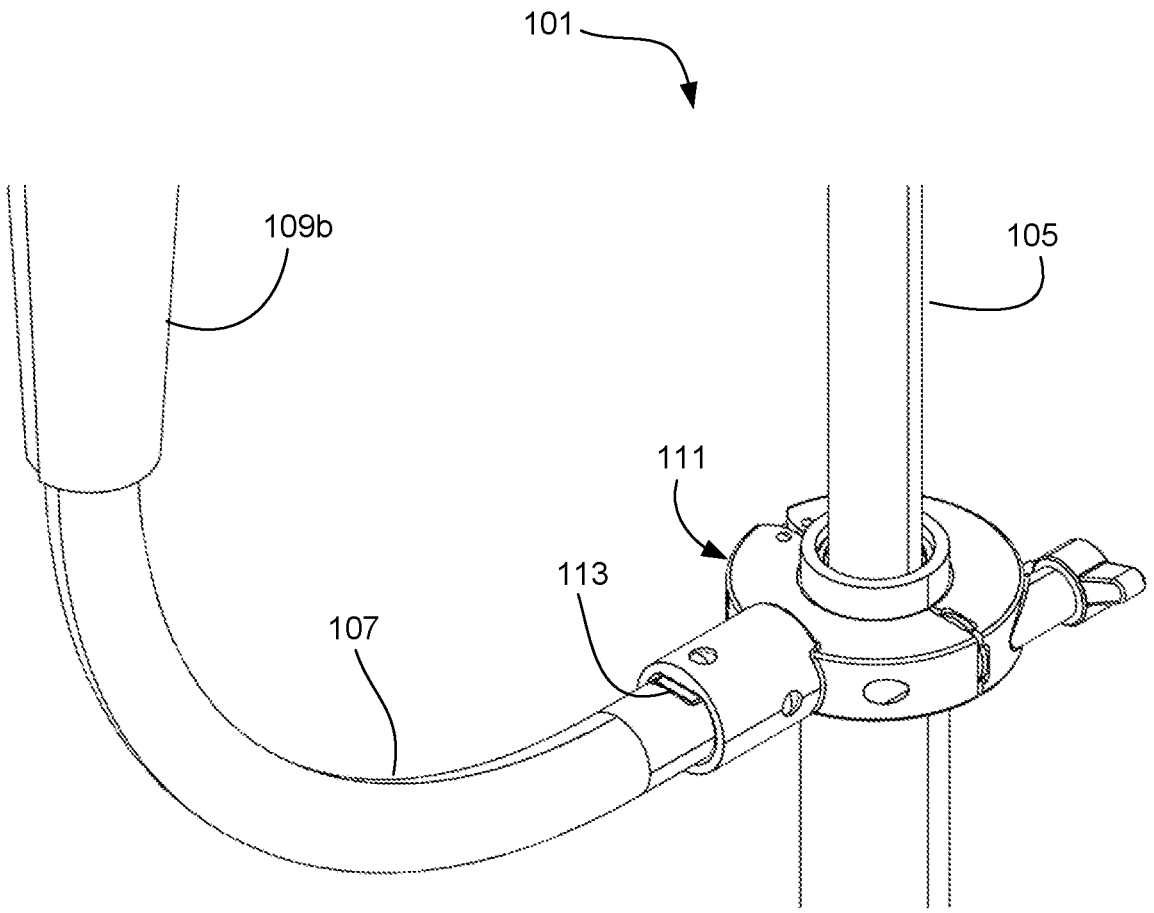
FIG. 3 is an enlarged perspective view of an auxiliary arm coupled to a tee stem of the training apparatus of FIG. 1.
Figure 4:
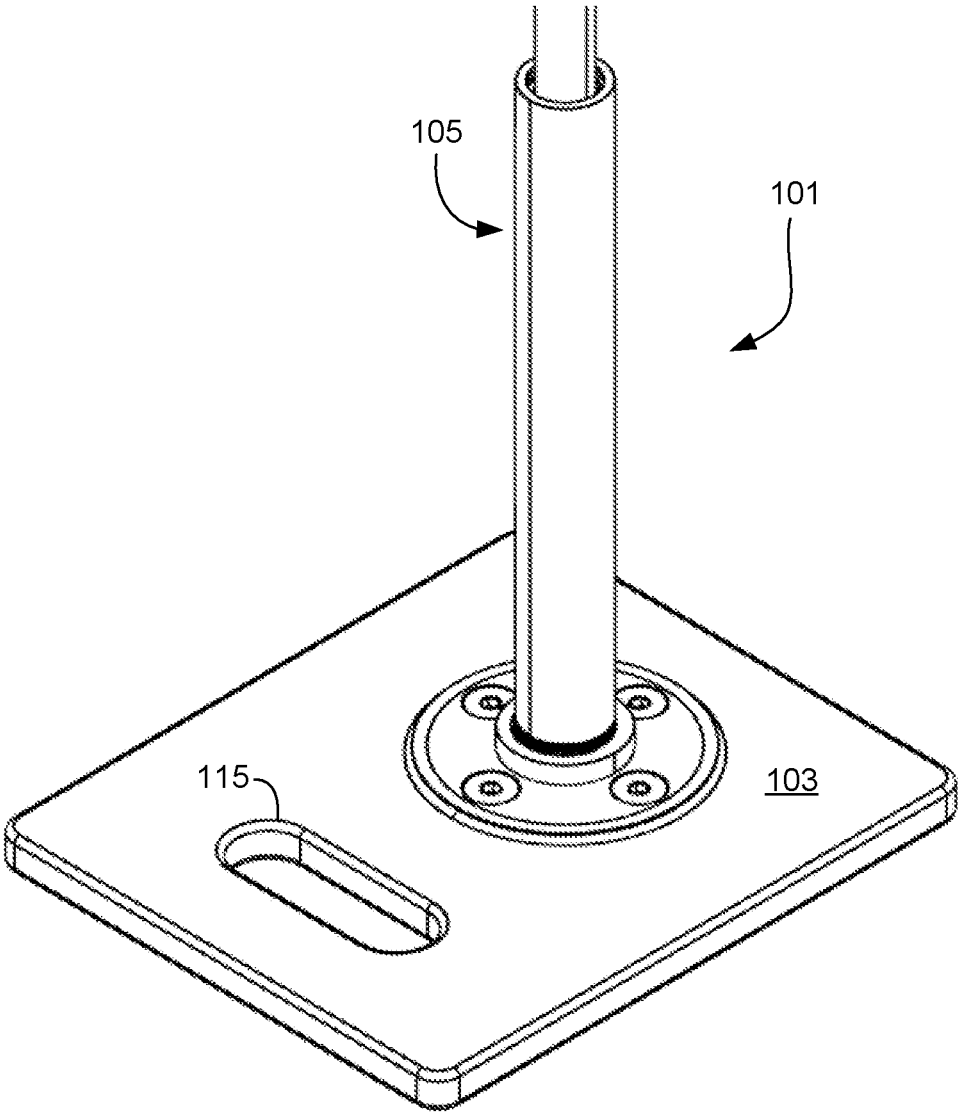
FIG. 4 is an enlarged perspective view of a base in the training apparatus of FIG. 1.

Referring now to FIGS. 1-4 in the drawings, views of a baseball training apparatus 101 are illustrated. It is understood that although apparatus 101 is described with respect to the sport of baseball, apparatus 101 is also equally useful to other sports such as softball or target sports in terms of holding a target for example. Apparatus 101 may include one or more different attachments to facilitate holding objects other than balls as herein described.

Training apparatus 101 is configured to facilitate the locating of one or more attachment members at variable heights relative to one another off a singular stem. Apparatus 101 includes a base 103, a main stem 105, and an auxiliary arm 107. Base 103 is weighted and configured to provide ballast so as to maintain main stem 105 in an upright orientation. Base 103 may be shaped in various designs and have a gradient of weight distributed about its area. Base 103 includes an optional handle 115. Handle 115 is shown as an aperture in FIGS. 1 and 2. It is equally understood that handle 115 may be a protrusion or groove/depression along a surface of base 103. Handle 115 is configured to increase the ability of a user to grip and handle apparatus 101.

Main stem 105 is coupled to base 103. The nature of the coupling may be done in various different ways. As shown in the Figures, one such method is to use an array of fasteners radially spaced about an upper surface of base 103. The fasteners are configured to thread into a portion of base 103. Main stem 105 is configured to be oriented relatively perpendicular to base 103. Although the particular orientation is shown as being fixed relative to base 103, it is conceivable that some embodiments may need or desire an ability to adjust the relative orientation between base 103 and main stem 105.

Main stem 105 includes one or more telescoping members configured to translate relative to one another. This allows main stem 105 to be adjustable in height. The members may operate independent of one another or collectively. A first end of main stem 105 is situated adjacent base 103. A second end of main stem 105 is distal from base 103 and is configured to accept an attachment member 109*a*. Adjustment of the telescoping members allows the height of attachment member 109*a* to be selectively changed. In operation a user may select the height for a particular purpose and then later on adjust the height.

Auxiliary arm 107 is configured to include a clamp configured to selectively couple to main stem 105. Clamp 111 is attached to a first end of arm 107 while an attachment member 109*b* is attached to a second end of arm 107. Auxiliary arm 107 is configured to be selectively located anywhere along the length of main stem 105 so at to locate attachment member 109*b* at some height relative to attachment member 109*a*. The height between members 109*a*/109*b* may be equal, where member 109*a* is above member 109*b*, or where member 109*b* is above member 109*a*. As seen in this embodiment, the act of adjusting the height of attachment member 109*b* is performed by adjustment of clamp 111 along main stem 105. In other embodiments it is understood that arm 107 may itself be configured to include one or more telescoping members or orientation adjusting members to serve to adjust orientation and/or height without the need to adjust clamp 111 location.

Auxiliary arm 107 is configured to be aligned with the orientation of main stem 105, however, other embodiments may permit adjustment or dissimilar orientations. As seen in more detail from FIG. 3 in the drawings, clamp 111 is enlarged. A slot 113 is formed at the first end of auxiliary arm 107. A fastener from clamp 111 engages the slot and thereby restricts or prevents the rotation of auxiliary arm 107. This describes only one way that undesired rotation along a relatively vertical plane may be prevented. Toothed shafts, gears, square first end of arm 107, and other ways are also possible. The first end 107 may include one or more slots about its perimeter to permit preset radial orientations. Various forms are conceived and permitted between a restricted singular orientation to a plurality of permitted orientations.

It is understood that while the rotation along the vertical plane has been described for auxiliary arm 107, the act of swiveling of arm 107 around main stem 105 has not. Auxiliary arm 107 may be rigidly affixed at a particular location on main stem 105. In such an embodiment, swiveling around main stem 105 may be prevented. Clamp 111 can act to restrict swiveling of arm 107 when secured. Some embodiments may permit selective swiveling of arm 107 through clamp 111 when secured. It is understood that clamp 111 may permit swiveling of arm 107 when clamp 111 is released.

Apparatus 101 is configured to allow for one or more training or competition exercises to be performed. Attachment members 109*a*/109*b* are cupped so as to support a ball. A baseball player may use a bat to hit the ball and thereby practice swings to improve performance. It is understood that arm 107 may be removed and a user may elect to use apparatus 101 with just the main stem 105. Furthermore, attachment members 109*a*/109*b* are configured in different shaped and means to be able to support any number of objects, such as cups for balls or clamps for targets. Attachment members 109*a*/109*b* may be interchangeable and detachable.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A training apparatus, comprising:

a base;

a main stem coupled to the base via a plurality of fasteners;

an auxiliary arm releasably coupled to the main stem, the auxiliary arm being adjustable in orientation relative to the main stem, the auxiliary arm including a slot configured to restrict rotation of the auxiliary arm relative to the main stem; and a clamp at a first end of the auxiliary arm, the location of the auxiliary arm on the main stem being adjustable through operation of the clamp, such that the auxiliary arm is adjustable in height relative to the base independent of the height to the main stem, the clamp configured to be selectively secured to the main stem and to permit selective swiveling of the auxiliary arm when the clamp is secured;

a fastener within the clamp configured to engage the slot of the auxiliary arm.

2. The apparatus of claim 1, wherein the base includes an aperture for a handle.

3. The apparatus of claim 1, wherein the main stem is configured to adjust in height via one or more telescoping members.

4. The apparatus of claim 1, wherein the auxiliary arm is configured to be selectively swiveled around the main stem.

5. The apparatus of claim 1, wherein the auxiliary arm includes a slot at the first end, the clamp is configured to contact the slot so as to prevent rotation of the auxiliary arm.

6. The apparatus of claim 1, wherein the main stem and the auxiliary arm being configured to include an attachment member.

7. The apparatus of claim 6, wherein the attachment member is configured to hold a ball.

8. The apparatus of claim 6, wherein the attachment member is detachable and interchangeable.

9. A method of operating a training apparatus, comprising:

obtaining the training apparatus of claim 1;

adjusting the height of the main stem;

locating the auxiliary arm onto the main stem;

wherein the main stem and the auxiliary arm include distinct attachment members, and selectively swiveling the auxiliary arm into position after the clamp is secured to the main stem.

10. The method of claim 9, further comprising adjusting the height of the auxiliary arm.

11. The method of claim 9, further comprising relocating the location of the auxiliary arm on the main stem.

12. The method of claim 9, further comprising removing the auxiliary arm from the main stem.

13. The method of claim 9, further comprising changing the height of the attachment members of the main stem and the auxiliary arm relative to one another.

14. The method of claim 9, further comprising interchanging at least one attachment member.

* * * * *